United States Patent [19]

Mills

[11] Patent Number: 4,572,272

[45] Date of Patent: Feb. 25, 1986

[54] METHOD OF CASTING USING NON-SILICA BASED CERAMIC CORES FOR CASTINGS

[75] Inventor: David Mills, Bristol, England

[73] Assignee: Rolls-Royce Limited, Bristol, England

[21] Appl. No.: 526,490

[22] Filed: Aug. 25, 1983

[30] Foreign Application Priority Data

Sep. 4, 1982 [GB] United Kingdom ..... 82225259

[51] Int. Cl.[4] ..... B22D 29/00

[52] U.S. Cl. ..... 164/131; 164/132

[58] Field of Search ..... 164/529, 132, 131, 122.1, 164/122.2, 519; 106/38.3, 38.9

[56] References Cited

U.S. PATENT DOCUMENTS

| | | | |
|---|---|---|---|
| 3,032,425 | 5/1962 | Leach | 106/38.3 |
| 3,968,828 | 7/1976 | Toeniskoetter et al. | 164/131 X |
| 4,130,157 | 12/1978 | Miller et al. | 164/529 X |

FOREIGN PATENT DOCUMENTS

| | | | |
|---|---|---|---|
| WO80/00134 | 2/1980 | PCT Int'l Appl. | 106/38.3 |
| 1070382 | 6/1963 | United Kingdom | 106/38.9 |
| 1602027 | 11/1981 | United Kingdom . | |
| 2084895 | 4/1982 | United Kingdom . | |

OTHER PUBLICATIONS

"Glossary of Chemical Terms", 2nd ed.; by C. A. Hampel et al.; pub. Van Nostrand Reinhold Co.; p. 153.

*Primary Examiner*—Nicholas P. Godici
*Assistant Examiner*—G. M. Reid
*Attorney, Agent, or Firm*—Parkhurst & Oliff

[57] ABSTRACT

Cores made from Alumina and other non-Silica based refractories can be made readily leachable in fused anhydrous caustic alkalis by the addition to the core of a small quantity of a material containing a Hydrogen donor group. The Hydrogen donor group is one which produces uncombined, or nascent Hydrogen when the ceramic is contacted with the anhydrous caustic alkali. Such groups are Hydroxyl groups, Hydrides or chemically combined water. In one disclosed example Silica which contains traces of water is added to high fired Alumina to provide the Hydrogen donor group. Only 2% to 3% Silica addition is required to make the Alumina readily soluble in the fused alkali.

11 Claims, No Drawings

METHOD OF CASTING USING NON-SILICA BASED CERAMIC CORES FOR CASTINGS

The present invention relates to non-Silica based ceramic cores for castings and a method of casting.

In casting of hollow gas turbine engine components, for example, turbine blades and vanes, the traditional ceramic core material has been Silica because of its combination of high refractoriness and ease of removal from the cast component by leaching with caustic alkali solutions.

Recent developments in casting gas turbine engine blades and vanes have involved directional solidification techniques, in which the ceramic cores are subject to higher temperatures for much longer periods of time, and it has been found that the Silica cores deform eventually, leading to high scrap rates in these casting processes.

Attention has thus been focussed on alternative materials of higher refractoriness for such processes, for example, Alumina. The problem with the materials of higher refractoriness is their leachability. Although a search of the chemical literature will show that it is possible to write a formula for a chemical reaction which suggests that Alumina is soluble in caustic alkali solutions, (see the Institute of Ceramics Textbook Series a book entitled "Raw Materials" by W. E. Worrall p. 93), the fact remains that the commercially available Alumina which is high fired, and highly densified to give it the strength and refractoriness required of a core for casting, has not been used as a core material because of the difficulty of its removal at practical rates by leaching.

Several attempts have recently been made to overcome this problem. For example, in U.K. Pat. No. 1,602,027 an Alumina core is described which is made as a compact having a specially formed highly porous interior which is relatively easily removed from a casting by a combination of leaching and mechanical break-up.

In another proposal cores formed from mixtures of Alumina with more easily leachable materials such as Silica or Magnesia have been made. We have found, however, at least with reference to mixtures of Alumina with Silica that, contrary to experience with Silica alone, where 20% to 30% Silica is present, the cores become less soluble as the concentration of the alkalis increase. Thus whereas Silica alone dissolves more rapidly in more highly concentrated alkalis, and is known to dissolve in fused anhydrous caustic alkali, an Alumina-Silica mixture having equal quantities of each substance becomes practically insoluble from castings in concentrated alkali solutions. We believe that this is due to the formation of insoluble Alumino-silicates which, in the small holes in the cast component prevent the alkali solution reaching the surface of the core.

In our U.K. Patent Application No. 8032060, now U.K. Published Patent Application No. 2084895, we disclose a process for removing Alumina cores from castings by caustic alkali solutions, but it was found that the Alumina had to be particularly pure to avoid the production of insoluble compounds which retarded the dissolution process. However, although the pure Alumina could be dissolved, it was still a relatively slow process and contrary to experience with Silica cores, increasing the concentrations of the caustic alkali solutions was only beneficial to a point, beyond which the solubility of the Alumina again decreased, and in the limit the Alumina became completely insoluble in fused anhydrous caustic alkalis.

It is an object of the present invention to provide a means of increasing the solubility of ceramic core materials other than Silica.

The object can be achieved by the method claimed in the appended claims in which a substance which contains a Hydrogen donor group is added to the ceramic material, and the ceramic material is then contacted by a fused anhydrous caustic alkali.

A Hydrogen donor group according to this specification is a chemical group, which breaks down to release nascent hydrogen during the dissolution process, for example, a hydroxyl group, a hydride or chemically combined water.

Also the substance which contains the Hydrogen donor group must retain the group at the temperatures used in the manufacture and use of the ceramic core.

We have found that Silica contains traces of water even after being electrically fused, and that the addition of small amounts, e.g. 2% to 3% by weight of Silica to non-Silica ceramic material, which is insoluble in fused anhydrous caustic alkalis, makes such a ceramic readily soluble in the anhydrous alkali. Thus, surprisingly, the addition of Silica in small quantities to an Alumina core, which rendered the Alumina less soluble in a caustic alkali solution, makes the Alumina readily soluble in a fused anhydrous caustic alkali.

It is believed that the released Hydrogen from the Hydrogen donor group acts either as a catalyst or reacts with the Alumina and the alkali in some manner to form a compound soluble in the alkali.

The essential feature of the present invention, which is to provide the Hydrogen donor group in the ceramic material itself, is applicable to non-Silica-based ceramic materials other than Alumina.

The caustic alkalis used in accordance with the invention are preferably Sodium, Potassium or Lithium hydroxide or mixtures thereof. Other hydroxides of elements in the same group of the Periodic Table may, however, be used.

In order to establish the validity of the discovery several test pieces were made starting from Alumina powder which had been fired at a temperature above 1600° C. The powder was blended with approximately 2% to 3% by weight of Silica powder and formed into rods 2 mm×10 mm×100 mm in size by a standard process of mixing with a resin binder and injecting into a die. The rods were then fired at 1500° C. to make a high strength refractory article.

The rods were dipped into a liquid mixture consisting of 40% fused anhydrous Sodium Hydroxide and 60% fused anhydrous Potassium Hydroxide at approximately 200° C. and within 15 minutes up to 10 mm of the rods had been dissolved.

Similar lengths of pure, high fired Alumina rod were put into the same mixture of fused anhydrous caustic alkalis and no discernible dissolution had taken place after four hours.

The optimum amount of Silica to be added to the Alumina can be varied between ½% to 10% by weight but usually amounts at the lower end of the range, e.g. 2% to 3% are preferred since the presence of too much Silica with the Aluminium can cause formation of insoluble Alumino-silicates which will start to retard the dissolution process. A further advantage of a small Silica addition is that it will increase the strength of a low fired preformed Alumina core.

Clearly the mixture ratio of the alkalis can be varied from pure Sodium Hydroxide to pure Potassium Hydroxide to obtain the best results, and the temperature of the bath may also be varied to determine the optimum in each case.

I claim:

1. A method of casting comprising the steps of:

making a core which contains between 90% and 99.5% by weight of a first, non-Silica based, ceramic material together with 10% to 0.5% by weight of a hydrogen donating second material which contains a Hydrogen donor group chemically bonded therein;

inserting the core into a casting mold;

pouring molten casting material into the mold, thereby surrounding the core, and allowing said casting material to solidify to form a cast component;

removing the cast component from the mold; and contacting the core with a fused anhydrous caustic alkali to dissolve the core from within the component.

2. The method of casting of claim 1, wherein said first, non-Silica based ceramic material is Alumina.

3. The method of casting of claim 1, wherein said hydrogen donating second material is Silica chemically bonded with said hydrogen donor group.

4. The method of casting of claim 3, wherein said Silica is 2% to 3% by weight of said core.

5. The method of casting of claim 1, wherein said hydrogen donating second material includes water which is chemically bonded therein.

6. The method of casting of claim 1, wherein said said hydrogen donating second material includes a hydroxyl or hydride group which is chemically bonded therein.

7. A method of casting comprising the steps of:

making a core which contains between 90% and 99.5% by weight of a high fired, high density alumina material, together with 10% to 0.5% by weight of a hydrogen donating second material which contains a hydrogen donor group chemically bonded therein;

inserting the core into a casting mold;

pouring molten casting material into the mold, thereby surrounding the core, and allowing said casting material to solidify to form a cast component;

removing the cast component from the mold and contacting the core with a fused anhydrous caustic alkali to dissolve the core from within the component.

8. The method of claim 7, wherein said hydrogen donating second material is silica chemically bonded with said hydrogen donor group.

9. The method of casting of claim 8, wherein said hydrogen donating second material is 2% to 3% by weight of said core.

10. The method of casting of claim 7, wherein said hydrogen donating second material includes water which is chemically bonded therein.

11. The method of casting of claim 7, wherein said hydrogen donating second material includes a hydroxyl or hydride group which is chemically bonded therein.

* * * * *